US005501377A

United States Patent [19]

Dubach

[11] Patent Number: 5,501,377

[45] Date of Patent: Mar. 26, 1996

[54] CENTRAL SEALING PIN CAP

[75] Inventor: Werner F. Dubach, Maur, Switzerland

[73] Assignee: Createchnic AG, Switzerland

[21] Appl. No.: 170,342

[22] PCT Filed: Apr. 16, 1993

[86] PCT No.: PCT/CH93/00099

§ 371 Date: Jan. 4, 1994

§ 102(e) Date: Jan. 4, 1994

[87] PCT Pub. No.: WO93/22212

PCT Pub. Date: Nov. 11, 1993

[30] Foreign Application Priority Data

May 4, 1992 [CH] Switzerland ..... 01422/92

[51] Int. Cl.[6] ..... B67D 3/00

[52] U.S. Cl. ..... 222/521

[58] Field of Search ..... 222/519, 520, 222/521, 549, 555

[56] References Cited

U.S. PATENT DOCUMENTS

| | | | |
|---|---|---|---|
| 3,259,282 | 7/1966 | Jellesen | 222/521 |
| 3,263,851 | 8/1966 | Grimsley | 222/521 |
| 3,319,843 | 5/1967 | Stull | 222/499 |
| 3,768,698 | 10/1973 | Corty, Sr. et al. | 222/91 |
| 4,646,949 | 3/1987 | Stull | 222/521 |
| 5,037,406 | 8/1991 | Smith et al. | 222/568 X |
| 5,044,530 | 9/1991 | Stull | 222/521 |
| 5,284,277 | 2/1994 | Levenberger | 222/521 |

FOREIGN PATENT DOCUMENTS

| | | |
|---|---|---|
| 0378488 | 7/1990 | European Pat. Off. . |
| 0412285 | 2/1991 | European Pat. Off. . |

*Primary Examiner*—Joseph A. Kaufman
*Attorney, Agent, or Firm*—Speckman, Pauley & Fejer

[57] ABSTRACT

A rotatable central sealing pin cap having a stationary part and a detachable pouring screw cap, each with engagable threads, an axial stop and a twist stop. A plurality of pre-assembly positions or intermediate positions can be defined. A twist stop is provided that limits rotational motion of the detachable pouring screw cap with respect to the stationary part beyond the completely open and the completely closed positions. At the same time, the detachable pouring screw cap is sealed to the stationary part to prevent an undesired backflow into the threaded region.

10 Claims, 2 Drawing Sheets

CENTRAL SEALING PIN CAP

BACKGROUND OF THE INVENTION

1. Field of the Invention

This invention relates to a rotatable central sealing pin cap for a container, having a stationary part fixed with respect to the container, as well as a detachable pouring screw cap threadedly adjustable with respect to the stationary part, for adjustment between an open and a closed position by moving a sealing pin on the stationary part into an opening in the detachable pouring screw cap.

2. Description of Prior Art

A closable central sealing pin cap is disclosed in U.S. Pat. No. 3,319,843. The two parts required are economically mass-produced from slightly flexible, deformable plastic in injection molding procedures. Two essential, basic requirements are made on the central sealing pin cap: problem-free function during use and the capability for easy assembly.

The closable central sealing pin cap of the '843 patent was designed for use with a reusable container and for easy cleaning of the closable central sealing pin cap. However, the high costs of taking back, cleaning and refilling the containers in industry have become disproportional to production costs, so that the disposable container, or more specifically, the disposable bottle, has caught on for many household applications, particularly for free-flowing media such as shampoos.

SUMMARY OF THE INVENTION

Today a substantial user-friendly quality is required of a rotatable central sealing pin cap that is reliable and simple to use without the danger of over-twisting. In addition, one object of the invention is that a closable central sealing pin cap must be assembled quickly, automatically and simply.

This object and other objects are achieved in a rotatable central sealing pin according to one preferred embodiment of this invention where a twist stop limits rotational movement in an opening direction and a closing direction, and an axial stop limits axial movement in an axial direction.

Although conventional central sealing pin caps can be automatically assembled, rotational motion is restricted only in a closing direction by a stop. In contrast, in accordance with one preferred embodiment of this invention, a twist stop limits rotational motion in a closing and an opening direction and an axial stop is provided for facilitating assembly. Most commonly used plastics allow a slight, flexible deformation, so that damage is prevented by a ratchet-like run-up of two threads on one another. This invention permits different and particularly advantageous embodiments. Thus the axial stop is preferably embodied as a pre-assembly stop or support shoulder for loose placement or preassembly of a detachable pouring screw cap on a stationary part to prevent a troublesome contact of the threads in a pre-assembly position. In this way the detachable pouring screw cap, which is produced separately, is first loosely placed on top and remains in this position without the threads touching one another. This allows the two parts to be brought toward one another in an axial orientation and the threads on both parts to be pressed over one another afterwards, so that these are precisely engaged when in a closed position of the cap. In one preferred embodiment, the axial stop is an annular shoulder on the stationary part and on the detachable pouring screw cap, and achieves the function of an annular sliding bearing.

In one preferred embodiment, the twist stop is formed from a radial rib and an annular wall that are disposed either on the detachable pouring screw cap or the stationary part, and an axially protruding positioning tip is disposed at the end of the annular wall to limit rotational motion of the two parts with respect to one another in the pre-assembly position. This position can be found either manually or automatically with, for example an assembly friction band that lightly touches laterally, and twists the detachable pouring screw cap until the annular wall touches the positioning tip. In this position the detachable pouring screw cap can be pushed over the axial stop from the pre-assembly position, and the threads of the stationary part and the detachable pouring screw cap can be pushed over one another into the closed end position of the central sealing pin cap. Moreover, it is important that the position of the twist stop and the position of the thread are matched such that the pouring screw cap can be brought from an initially closed position into a completely open position by rotational movement of 90° to 180°. In one preferred embodiment, the stationary part and detachable pouring screw cap are triple-threaded.

In another preferred embodiment, the axial stop formed by the annular shoulders forms a sealing point on the stationary part and the detachable part in the open position of the central sealing pin cap to prevent backflow from the contents of the container to enter the region of the threads of both parts.

It is also possible to embody the container cap in two parts or as a detachable part and a stationary part on the container itself.

One preferred embodiment of this invention will be explained in further detail below.

DESCRIPTION OF PREFERRED EMBODIMENTS

Figure 6:
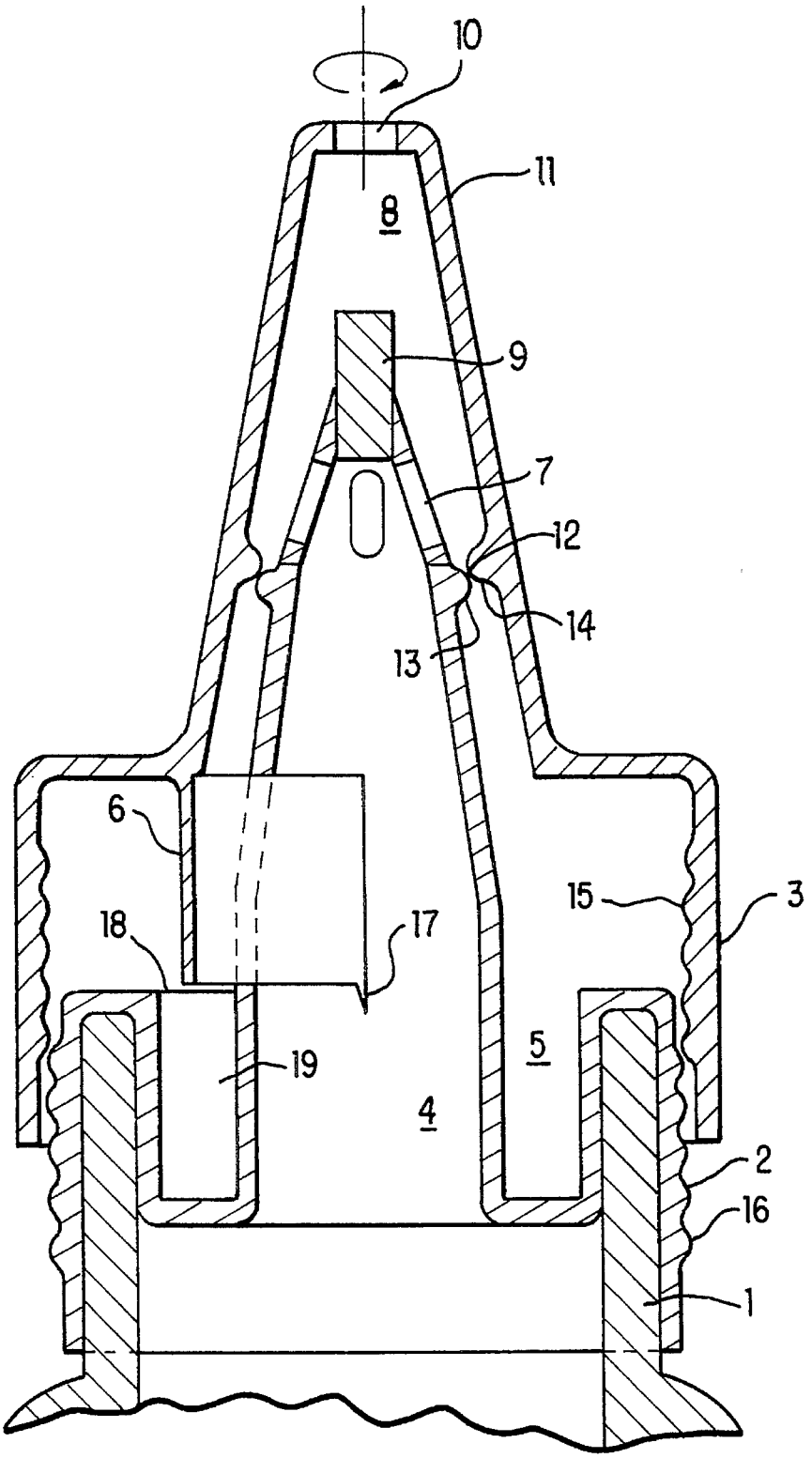
FIG. 6 is an enlarged cross-sectional view of a central sealing pin cap as shown in FIG. 2.

FIG. 6 shows a stationary part 2 and a detachable pouring screw cap 3 on a container 1 in a pre-assembly position. In FIG. 6 the stationary part 2 is pressed on or welded within the pouring opening 4 of the container 1. The stationary part 2 is intended to seal against the container 1 and not to be rotated. The stationary part 2 has an annular conduit 5, into which an annular wall 6 of the detachable pouring screw cap 3 can be pushed. The annular conduit 5 is dimensioned such that it rests sealingly with an outer surface against the neck of the container 1 and forms a flowthrough opening with an inner surface. Like the detachable pouring screw cap 3, the upper pouring end of the stationary part 2 has a nozzle and holes 7, through which a liquid can flow from the interior of the container 1 into an overflow chamber 8.

Figure 3:
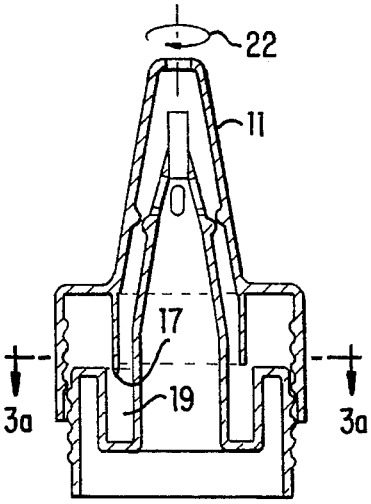
FIG. 3 is a cross-sectional view of a central sealing pin cap with the detachable pouring screw cap, rotated 90° with respect to the stationary part in the position shown in FIG. 2, according to one preferred embodiment of this invention.

The upper end of the stationary part 2 has a sealing pin 9 that fits into a corresponding sealing bore 10 of the detachable pouring screw cap 3. The detachable pouring screw cap 3 is placed loosely on the stationary part 2, as shown in FIG. 6 and supported in this position by an axial stop 12. The axial stop 12 is formed by contact surfaces of an annular shoulder 13 on the stationary part 2 and an annular shoulder 14 on the detachable pouring screw cap 3. In this position the detachable pouring screw cap 3 can be rotated up to 360° angular degrees, depending on the initial position, without axial displacement and contact of the threads 15 or 16. A positioning tip 17 disposed at the end of the annular wall 6 is stopped by the upper end 18 of a radial wall 19 when the detachable pouring screw cap 3 is rotated as shown in FIG. 3, so that the detachable pouring screw cap 3 can be pushed into the annular conduit 5 without the risk of damage, wherein the threads 15 and 16 must glide over one another.

Figure 1:
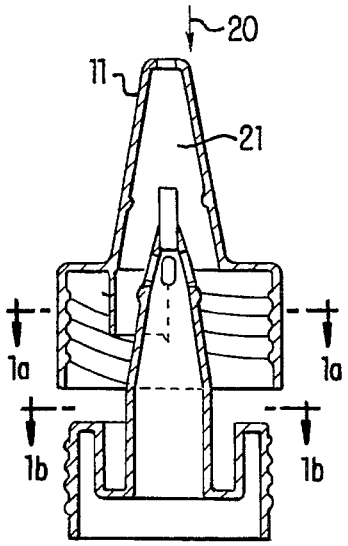
FIG. 1 is a cross-sectional view of a central sealing pin cap showing the orientation of the parts of a central sealing pin cap for assembly, according to one preferred embodiment of this invention.

FIGS. 1 through 5 show the function of this invention. The beginning of assembly of the stationary part 2 and the detachable pouring screw cap 3 is shown in FIG. 1. The detachable pouring screw cap 3 is placed loosely onto the stationary part 2 by moving the detachable pouring screw cap 3 in a direction 20 which is in the direction of the axis 21. The rotational position of the detachable pouring screw cap 3 with respect to the stationary part 2 is initially irrelevant.

Figure 2:
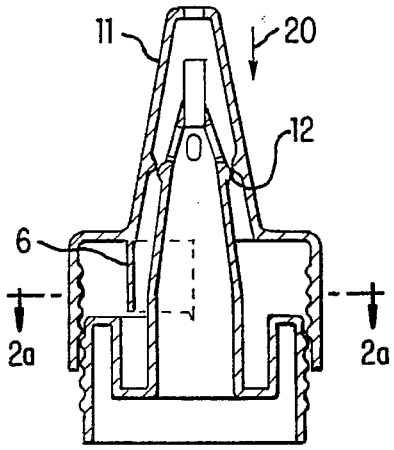
FIG. 2 a cross-sectional view of a central sealing pin cap in a pre-assembly position, according to one preferred embodiment of this invention.
Figure 1A:
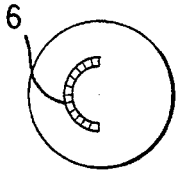
FIG. 1*a* is a cross-sectional diagrammatic view of a central sealing pin cap taken along line A—A, as shown in FIG. 1.
Figure 1B:
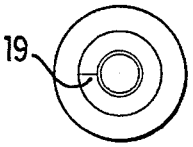
FIG. 1*b* is a cross-sectional diagrammatic view of a central sealing pin cap taken along line B—B, as shown in FIG. 1.
Figure 2A:
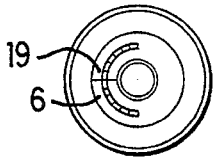
FIG. 2*a* is a cross-sectional diagrammatic view of a central sealing pin cap taken along line C—C as shown in FIG. 2.

As shown in FIG. 2 the detachable pouring screw cap 3 rests on the axial stop 12. As shown in FIG. 2, the inside thread 15 of the pouring screw cap 3 and the outside thread 16 of the stationary part 2 do not engage, and the annular wall 6 does not touch the upper edge 18 of the radial wall 19 of the twist stop. As can be seen from FIGS. 1*a* and 1*b* or 2*a*, the annular wall 6 is in an arbitrary position, such as directly above the radial wall 19. If the detachable pouring screw cap 3 were to be pressed down forcefully in this position, this would lead to the destruction of the annular wall 6 and the radial wall 19. To prevent this, detachable pouring screw cap 3 may be rotated by approximately 270° angular degrees, until the positioning tip 17, which already protrudes beyond the radial wall 19, prevents the detachable pouring screw cap 3 from rotating any further. The positioning tip 17 may be of such a thickness that it provides a laterally engaging, powered friction band for automatic assembly with sufficient resistance against further rotation. The direction of rotation is indicated by the arrow 22.

Figure 4:
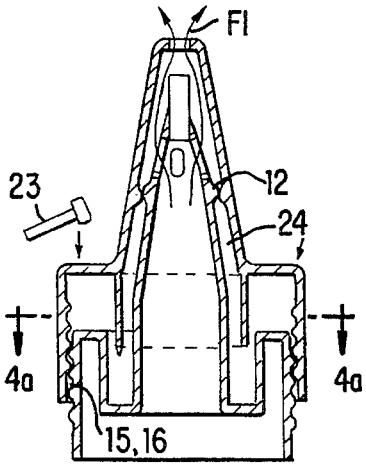
FIG. 4 is a cross-sectional view of a central sealing pin cap in an open position with the detachable pouring screw cap engaged with respect to the stationary part, according to one preferred embodiment of this invention.
Figure 3A:
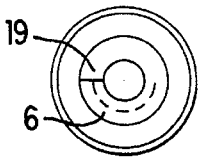
FIG. 3*a* is a cross-sectional diagrammatic view of a central sealing pin cap taken along line D—D, as shown in FIG. 3.

It can be see from FIG. 3*a* that the annular wall 6, located next to the radial wall 19, does not restrict further axial movement of the detachable pouring screw cap 3. In FIG. 4 a hammer 23 symbolically represents the pressing in of the annular shoulder of the detachable pouring screw cap 3 over the annular shoulder 13 of the stationary part 2 which form a snap fit connection, wherein the threads 15 and 16 engage at the end of this axial movement and the cap reaches the completely closed position. FIG. 4 shows the completely open position of the cap. In this position the liquid F1 can exit via the holes 7 and the overflow chamber 8. In this position it is also important that annular shoulders 13 and 14 seal when they touch one another. This prevents a backflow of the liquid via the intermediate chamber 24 into the region of the threads 15 and 16.

Figure 5:
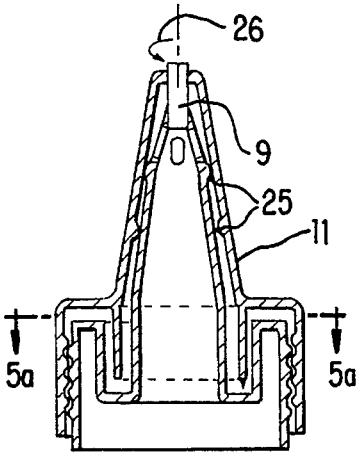
FIG. 5 is a cross-sectional view of a central sealing pin cap in a completely closed position, according to one preferred embodiment of this invention.
Figure 4A:
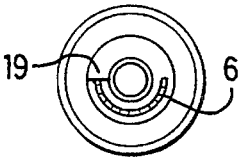
FIG. 4*a* is a cross-sectional diagrammatic view of a central sealing pin cap taken along line E—E, as shown in FIG. 4.
Figure 5A:
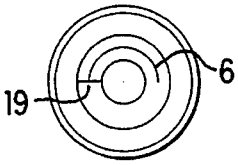
FIG. 5*a* is a cross-sectional diagrammatic view of a central sealing pin cap taken along line F—F, as shown in FIG. 5.

As shown in FIG. 5 the detachable pouring screw cap 3 is brought into the completely closed position by means of the threads 15 and 16, and the sealing pin 9 and the sealing bore 10 form a valve closure. Furthermore, it is significant that, in this position, the annular shoulders 13 or 14 can perform a sealing function with respect to the opposite wall so that, even in this position, no liquid flows backward into the threads. The rotational closing movement is indicated by the arrow 26. As shown in FIG. 5*a*, the annular wall 6 impacts upon the radial wall 19 from the opposite side in a position rotated by 180° with respect to the orientation of the annular wall 6 as shown in FIG. 4*a*. This means that rotation of the detachable pouring screw cap 3 beyond the open and closed positions is limited by twist stop 19, and it is not possible to pull off the detachable pouring screw cap 3 without a tool. The central sealing pin cap is therefore simple and reliable in every respect for the consumer and all desired functions are performed optimally.

I claim:

1. In a rotatable central sealing pin cap for a container (1), having a stationary part (2) fixed with respect to the container (1), a detachable pouring screw cap (3) threadedly adjustable with respect to the stationary part (2) for adjustment between an open and a closed position of the rotatable central sealing pin cap with respect to a sealing pin (9) oriented toward an opening (10) of the detachable pouring screw cap (3), the improvement comprising: a radial wall (19) attached to the stationary part (2), an annular wall (6) attached to the detachable pouring screw cap (3), a positioning tip (17) extending from a bottom edge of said annular wall (6), a first annular shoulder (13) positioned on the stationary part (2), a second annular shoulder (14) positioned on the detachable pouring screw cap (3); at a position of contact between an upper portion of the first annular shoulder (13) add a lower portion of the second annular shoulder (14) internal threads (15) on an internal wall of the detachable pouring screw cap (3) being disengaged from external threads (16) on an external wall of the stationary part (2), said positioning tip (17) extending below an upper edge of said radial wall (19) and interfering with said radial wall (19) to limit rotation of said detachable pouring screw cap (3) with respect to said stationary part (2).

2. In a rotatable central sealing pin cap according to claim 1, further comprising snap means for forming a snap fit connection between said first annular shoulder (13) of the stationary part (2) and said second annular shoulder (14) of the detachable pouring screw cap (3) upon mechanical pressure on the pouring screw cap (3).

3. In a rotatable central sealing pin cap according to claim 2, wherein said internal threads (15) and said external threads (16) comprise engageable triple threads requiring from a 90° to 180° rotational movement of the detachable pouring screw cap (3) with respect to the stationary part (2) to move from a closed position into a completely open position of the detachable pouring screw cap (3) with respect to the stationary part (2).

4. In a rotatable central sealing pin cap according to claim 3, wherein at least one of said first annular shoulder (13) and said second annular shoulder (14) forms a seal in said open position of the cap to prevent backflow of a content of the container (1) into an area surrounding said internal threads (15) and said external threads (16).

5. In a rotatable central sealing pin cap according to claim 4, wherein the rotatable central sealing pin cap is formed by two independent parts.

6. In a rotatable central sealing pin cap according to claim 4, wherein the stationary part (2) is integral with the container (1).

7. In a rotatable central sealing pin cap according to claim 1, wherein said internal threads (15) on said internal-wall of the detachable pouring screw cap (3) and said external threads (16) on said external wall of the stationary part (2) comprise engageable triple threads requiring from a 90° to 180° rotational movement of the detachable pouring screw cap (3) with respect to the stationary part (2) to move from a closed position into a completely open position of the detachable part (3) with respect to the stationary part (2).

8. In a rotatable central sealing pin cap according to claim 1, wherein at least one of said first annular shoulder (13) and said second annular shoulder (14) forms a seal in said open position of the cap to prevent backflow of a content of the container (1) into an area surrounding said internal threads (15) on said internal wall of the detachable pouring screw cap (3) and said external threads (16) on said external wall of the stationary part (2).

9. In a rotatable central sealing pin cap according to claim 1, wherein the rotatable central sealing pin cap is formed by two independent parts.

10. In a rotatable central sealing pin cap according to claim 1, wherein the stationary part (2) is integral with the container (1).

* * * * *